United States Patent [19]

Gilliland

[11] 4,240,167

[45] Dec. 23, 1980

[54] FLUSH VALVE CONTROL APPARATUS

[76] Inventor: Elbert G. Gilliland, 1801 Francis Rd., Knoxville, Tenn. 37919

[21] Appl. No.: 938,936

[22] Filed: Sep. 1, 1978

[51] Int. Cl.[3] ..... E03D 1/14; E03D 1/34

[52] U.S. Cl. ..... 4/324; 4/396; 4/397; 4/405; 4/413

[58] Field of Search ..... 4/324, 325, 326, 345, 4/378, 381, 392, 393, 394–397, 405, 412, DIG. 1, 327, 346, 379, 411, 413, 414, 415

[56] References Cited

U.S. PATENT DOCUMENTS

| | | | |
|---|---|---|---|
| 1,272,091 | 7/1918 | Quinn | 4/401 |
| 1,507,816 | 9/1924 | Davison | 4/395 |
| 2,440,389 | 4/1948 | Anderson, Sr. | 4/324 |
| 2,526,294 | 10/1950 | Stegeman | 4/395 |
| 2,602,934 | 7/1952 | McCormick | 4/324 |
| 2,626,400 | 1/1953 | Castellano | 4/324 |
| 2,817,849 | 12/1951 | Hewitt | 4/381 |
| 2,908,914 | 10/1959 | Lasecko | 4/324 |
| 3,047,882 | 8/1962 | Goodwin | 4/325 |
| 4,032,997 | 7/1977 | Phripp et al. | 4/324 X |
| 4,067,074 | 1/1978 | Harrison | 4/324 |

*Primary Examiner*—Stuart S. Levy

*Attorney, Agent, or Firm*—Pitts & Kesterson

[57] ABSTRACT

A flush valve control apparatus for selectively closing, at the option of the operator, the flush valve of a flush toilet is disclosed. The apparatus includes a control member which is located such that it can selectively push against the flush valve which opens and closes the outlet pipe of a flush toilet. The control member which is normally in a non-control relationship with the flush valve is attached by a hinge to the standpipe such that it may be rotated downward until it contacts the top portion of the valve. A rod is pivotally attached to the control member at one end and slidably attached to a line at its second end. The link is attached to the handle of a trip lever, such as is normally found in conventional toilets. On forcing the trip lever downward by rotating the handle in a direction opposite to that for flushing, the link slides along the rod until it meets a stop. The link upon reaching the stop, urges the rod downward and causes the control member to rotate about its hinge and force the flap valve member downward over the opening of the outlet pipe. Upon releasing the handle, a spring causes the control member to rotate upward and return it to its normal position such that it is no longer in contact with the flush valve.

6 Claims, 7 Drawing Figures

FLUSH VALVE CONTROL APPARATUS

BACKGROUND OF THE INVENTION

This invention relates generally to flush toilets, and more particularly to an apparatus which may be applied to flush toilets incorporating a conventional flap-type valve for closing the flush outlet and which will allow the selected closing of such valve after flushing.

Traditionally, flush toilets which make use of a reservoir or a holding tank for water prior to the necessity of evacuating the bowl have utilized more water than was necessary. The excessive use of water in the past when water was plentiful was not considered a problem. However, the advent of more densely populated areas and the increased concern for the conservation of natural resources, has made such waste unacceptable.

In line with such conservation ideas, it would be an advantage to provide a flush toilet which selectively controls the amount of water flowing from the reservoir into the bowl. It is therefore one object of this invention to provide an apparatus for selectively closing at will the water outlet of the conventional reservoir or toilet tank.

Many of the newer conventional flush toilets using a toilet tank or reservoir use a flap-type valve to restrict water flow from the tank to the bowl. Often times after flushing, the flap on the valve remains open due to sticking or for any number of reasons does not close or closes but does not form a good seal. This then allows the water to continue to flow from the tank into the bowl and results in waste. Therefore, an additional object of this invention to provide a means for closing the flap valve when it does not close automatically or closes but does not form a good seal. It is still another object of this invention to provide inexpensive and easily maintained apparatus for selectively closing the flap valve on a flush toilet which utilizes a reservoir or tank.

Another problem often encountered in the use of flush toilets utilizing a reservoir is overflow. It is not uncommon for the waste lines which drain the bowl of a conventional toilet to become clogged or otherwise impassable due to waste or some foreign object blocking or slowing passage. In conventional toilets, once the flush cycle is commenced, all the water in the tank will empty into the bowl whether the bowl can accept it or not. The operator of the toilet may not notice the line stoppage until after flushing. If the bowl is unable to drain, the water from the tank fills the bowl and then overflows onto the floor. This overflow can cause extensive damage to the flooring as well as leaving the operator with an unsightly mess to clean. It is therefore an object of this invention to provide an apparatus which will allow the operator upon observing that the bowl is not emptying properly to selectively terminate the flow of water from the tank. These and other objects and purposes will become apparent to those skilled in the art upon reading the following descriptive disclosure.

Another apparatus which regulates the control of flow from the tank into the bowl is shown in U.S. Pat. No. 2,817,849 issued Dec. 31, 1957 to George Hewitt. A flush tank valve control means is disclosed which includes a float operated foot for grasping a valve stem that has been moved in a flush position until the tank has been completely flushed and then partially refilled the grasping foot also allows the operator to close the valve at any time as the tank is being drained, thereby controlling the amount of water used during the flushing operation. With this structure, one may manually control the operation thereof to use less than the total tank capacity of water. However, this particular invention, among other things, requires the use of a float mechanism which is in addition to the float required to operate the water inlet valve.

Two embodiments of this invention are illustrated in the accompanying drawings, in which like numerals denote like parts throughout several views, and in which.

In accordance with the various features of the invention, an apparatus for selectively closing, at the option of the operator, the flush valve of a flush toilet utilizing a flush tank is shown. The apparatus includes a central or foot member, one portion of which may selectively push against a valve member or flap adapted to open and close the outlet pipe from a toilet tank. Another portion of the foot member is adapted to be hingedly attached to another part of the toilet tank, such as a standpipe, such that the foot member may rotate about the hinged attachment between an upward and downward position. The foot member is located within the tank such that when the foot member is rotated about said hinge to a downward position, the valve flap is pushed to a closed position and stops the outflow of water from the tank through the outlet pipe. One end of a rod is attached by a hinge to the said member. A first stop mechanism is positioned at the second end of said rod. A second stop is placed on said rod at a position between its first end and second end. Also included is a link having one end attached to the trip lever which is controlled by the control handle outside the tank and the other end slidably attached to the rod between the first and second stops such that the link may slide freely up and down said rod as the trip handle is operated, but is not able to slide past either stop. When the trip handle is operated in such fashion as to cause the link to move in a downward direction, the arm slides down the rod until it engages the second stop. The link then pushes against the stop which causes the rod to move downward. The downward force causes the foot to rotate and engage the valve flap and then move the valve flap to a closed position.

In one embodiment the control handle is spring biased such as to keep the link and consequently the foot from its down position. In a second preferred embodiment a mount is attached to some portion of the toilet tank, such as the standpipe. A second rod is slidably attached to the mount such that said rod is free to move upward and downward. A first end is pivotally attached to the foot in a manner similar to the first rod and the second end of the second rod is spring biased against said mount. After the foot is moved in such fashion as to close the valve member, the second rod pulls the foot member upwardly and away from the valve member.

Figure 1:
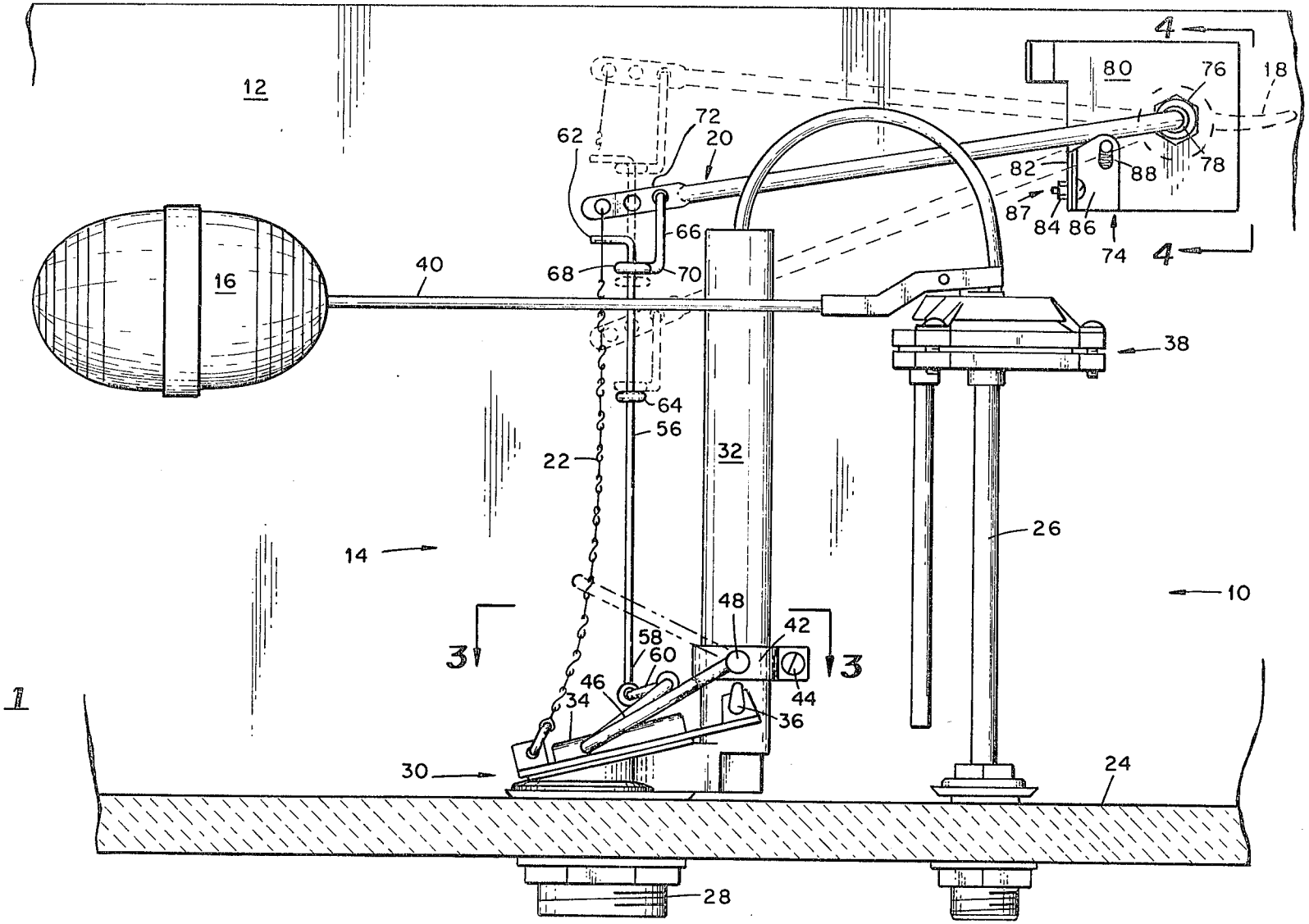
FIG. 1 illustrates a first embodiment of this invention, seen in elevation.

Referring now to the drawings and more specifically to FIG. 1, a toilet tank 10 is shown. This tank is typical of that type of tank used in flushing-type toilets. The back wall of the tank is not shown in order that the mechanism inside the tank may be clearly illustrated. A portion of the front wall 12 is shown and also shown is the flushing mechanisms generally referred to as 14. Included in the flushing mechanism 14 are the conventional elements such as the float 16, the trip handle 18, the trip lever 20 and the lift chain 22 which is attached at one end of lever 20. Fitted through the bottom wall 24 of tank 10 are a water inlet pipe 26 and a water outlet pipe 28. Mounted in communication with the water outlet pipe is the water outlet valve generally designated 30 and an overflow standpipe 32. The outlet control valve 30 is a flap-type valve having a flap 34 covering the outlet pipe 28 at its opening when in the closed position and hingedly attached at 36 to standpipe 32. It should be appreciated, of course, that flap 34 could be hinged to some other suitable support and that standpipe 32 is selected in this embodiment because of its convenience. Chain 22 is attached to flap 34 such that when the chain is raised, flap 34 rotates about its hinge and allows water to drain out of tank 10. Water inlet pipe 26 has a valve 38 attached thereto which selectively controls the addition of water to tank 10. Float arm 40 is connected at one end to float 16 and the other end to valve 38. When float 16 is in a lowered position, valve 38 is open and allows water to flow into the tank 10. As water is added to the tank, it raises float 16 to a point where valve 38 is shut off and stops the flow of water into the tank.

Figure 3:
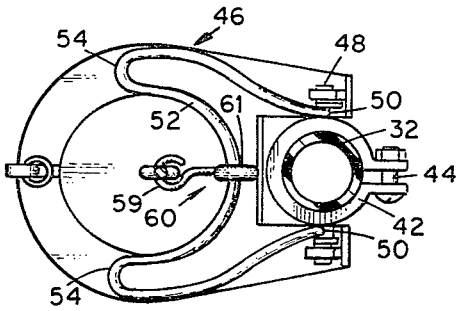
FIG. 3 illustrates a top view showing a detail of the closing member of this invention as seen in FIG. 1.

According to this invention, means is provided to selectively make contact with flapper 34 of valve 30. In this regard, a clamp member 42 is secured to the overflow standpipe 32 at a location above hinge 36. Even though standpipe 32 is chosen to hold clamp member 42, other means for securing the clamp within the tank could be provided. Clamp member 42 is equipped with a screw 44 for tightening purposes and pins 48 which serve as pivot points. Hinged to clamp 42 by pins 48 is foot 46. In the embodiment as shown, this hinge allows foot 46 to rotate in a counterclockwise direction about pins 48 until it comes into contact with flapper 34 and then forces flapper 34 down against outlet pipe 30. Referring to FIG. 3, foot 46 is shaped from a section of malleable rigid material, as by example, copper wire. The ends are formed into loops which fit around pins 48 on clamp member 42 to form the hinge. Foot 46 also has a C-shaped portion 52 formed in the center of such section of malleable material. This C-shaped portion has two end portions 54 which are designed to contact the top of flapper 34 near its periphera. It will be appreciated, of course, that foot 46 could also be molded from a high-impact plastic or other material.

To connect foot 46 with trip lever 20, a freely reciprocal thrust rod 56 has one end 58 hingedly attached to one end 59 of a connecting arm 60 by a loop. The other end 61 of said arm 60 is rigidly attached to the midpoint of the C-shaped portion of foot 46. It will be appreciated that arm 60 might be manufactured as an integral part of foot 46. The other end of thrust rod 56 is bent at a right angle at 62 to form a stop. A second stop 64 is located approximately midpoint on rod 56 and is permanently mounted to said rod 56. In a similar manner, stop 64 may be a piece of malleable material permanently fixed to said rod 56 as by soldering as is shown or could also comprise a securely attached collar. Although the right angle end 62 as shown in the embodiment of FIG. 1 is a simple and inexpensive way of providing a stop at the top end of rod 56, it should be understood that other types of stops would be suitable. For example, a collar could be securely attached to rod 56 by welding, soldering, bronzing or by means of a set screw. Rod 56 is manufactured from a substantially rigid malleable material, as by example, copper wires, and when held in place is substantially vertical within the tank.

Thrust rod 56 is connected to the trip lever 20 by means of a thrust rod link 66. One end of said link 68 forms a loop. A bend 70 is made in order to cause said loop 68 to be perpendicular to the remaining portion of the thrust rod link 66. Loop 68 is slidably attached around thrust rod 56 between end 62 and stop 64 such that the loop may not slide past end 62 and stop 64 and to retain said thrust rod substantially vertical. The other end of thrust rod link 66 is attached at 72 to the chain end of trip lever 20. Thrust rod link 66 is manufactured from a substantially rigid malleable material, as by example, copper wire, which is similar to thrust rod 56. Rod link 66 may be a separate component as is shown in the Figures, or alternately as will be appreciated by those skilled in the art, rod link 66 could be an integral part of trip lever 20.

Figure 4:
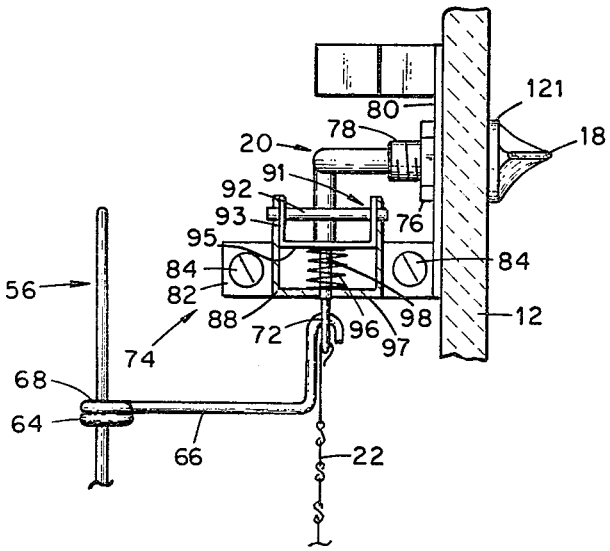
FIG. 4 illustrates a side view of a portion of FIG. 1 showing a detail of the trip lever handle.

Means is provided for returning foot 46 to an upward position after use in closing valve 30. To this end, a bracket, generally designated 74 in FIG. 1, is attached to the inside of tank wall 12 by means of a threaded nut 76 and threaded conduit 78. Conduit 78, as will be appreciated by those skilled in the art, provides a passage and support such that handle 18 on the outside of tank 10 may be attached to trip lever 20. Bracket 74 consists of a plate 80 which is secured against the inside of wall 12. A portion 82 of said plate 80 is formed at a right angle beneath a portion of trip lever 20. Attached to said right angle 82 by means of screws and nuts 84 is holding mount 86. Holding mount 86 could, of course, also be permanently attached to right angle 82 by welding, soldering or the like. As is shown in FIGS. 1 and 4, holding mount 86 has two parallel sides wherein elongated vertical slots 88 are cut. A roller 92 with pins slides within said slots. A U-shaped member 91 with legs 93 and a center portion 95 slides vertically between the parallel sides of mount 86. Legs 93 press upward against the pins of roller 92. A compression spring 96 is biased against the center portion 95 and the bottom 97 of mount 86 is held in position by an alignment leg 98 which is attached to center portion 95 and slides through a slot in the bottom of mount 86. A portion of trip lever 20 rests on said roller. Spring 96 maintains sufficient force against said member 91 to hold said trip lever arm 20 and roller 92 up until such time as a force is applied to compress said spring 96 and cause said roller 92 to ride downward within said vertical slots 88. Upon reduction of the force to handle 18, the spring pushes against member 91 and causes roller 92 to ride upward within slots 88 and return it to its original upward position. The dotted line representations of trip lever 20 in FIG. 1, show the two possible extreme positions of trip lever 20.

Figures 2, 7:
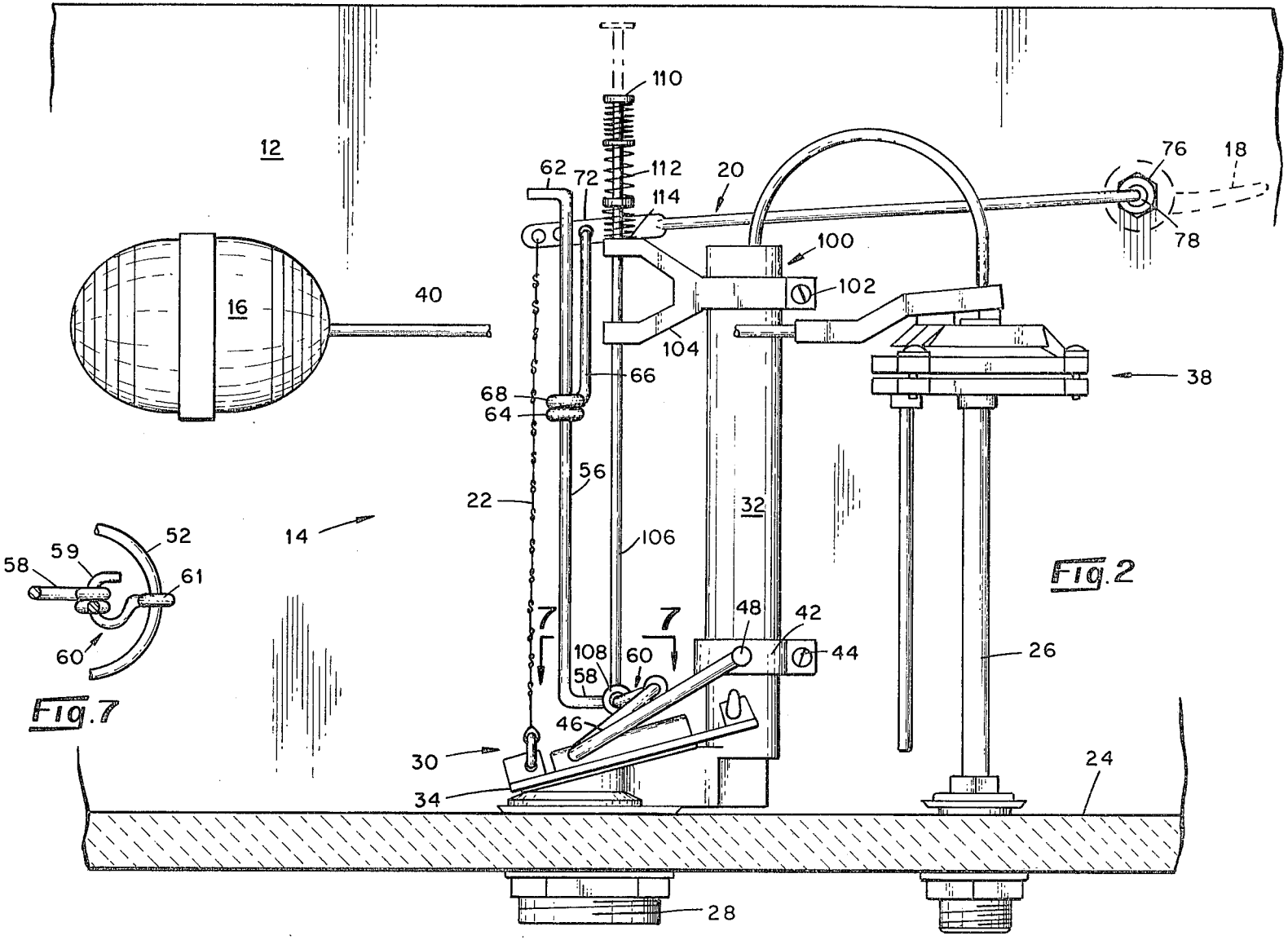
FIG. 2 illustrates a second embodiment of this invention, seen in elevation.
FIG. 7 illustrates a top view of the detail of the embodiment shown in FIG. 2.

An alternate embodiment of said invention is shown in FIG. 2. Said alternate embodiment of said invention is shown in FIG. 2. Said alternate embodiment is similar to the first embodiment with regards to a clamp member 42, which member is attached to standpipe 32. Hingedly attached to said clamp member 42 is foot 46 which is similar to that found in the first embodiment of this invention. The foot thrust rod 56 is hingedly attached to one end of a connecting arm 60. The other end of connecting rod 60 is permanently attached to the midpoint of the C-shaped portion 52 of foot member 46. As before, said foot thrust rod 56 has a curved end at 62 which forms a stop and a stop 64 which is mounted between the two ends of rod 56. Thrust rod link 66 has one end slidably attached to foot thrust rod 56 between stop end 62 and stop 64 by means of a loop which surrounds said rod 56. The other end of said thrust rod link is attached at 72 to the chain end of trip lever 20.

This embodiment utilizes an alternate means for returning said foot member 46 to the normally upward position. With regards to said alternate means, a clamp member 100 is secured to standpipe 32 above clamp member 42. A screw 102 is provided for tightening said clamp member 100 securely to said standpipe 32. One portion of said clamp member 100 forms a bracket 104. A foot retractor rod 106 is slidably mounted within said bracket 104 and is maintained in a substantially vertical position. One end of said foot retractor rod 106 is pivotally mounted at 108 by means of a loop to the same end of rod 60 as is foot thrust rod 56 shown in detail in FIG. 7. The other end of rod 106 is T-shaped at 110 and provides a stop. A compression spring 112 surrounds a portion of rod 106 and is maintained between end stop 110 and the upper portion of bracket 104 at 114. As rod 106 is forced downward, compression spring 112 is deformed between stop 110 and bracket 104 at 114. As the downward force to rod 106 is relieved, spring 112 forces rod 106 upward which rotates foot 46 upward and disengages foot 46.

The apparatus is activated when flapper 34 is in the open position and it is desired that said flapper be closed. The operator applies an upward force on handle 18 which in turn causes the chain end of trip lever 20 to rotate downward. The downward rotational force of trip lever 20 causes thrust rod link 66 to slide along foot thrust rod 56 until it engages stop 64. When the thrust rod link 66 engages stop 64, this carries foot thrust rod 56 downward applying force to foot 46. In turn then, foot 46 rotates downward about pins 48 on clamp 42 and engages the top of flapper 34 at 54 of foot 46 thereby causing flapper 34 to rotate about its axis until it covers the opening to outlet pipe 28. After the closure of the opening by flap 34, the operator reduces the upward force to handle 18 or releases it completely. This in turn allows, as in preferred embodiment FIG. 1, the spring mechanism generally designated 87 to push against trip lever 20 and urge the chain end of trip lever 20 upward. This in turn causes thrust rod link 66 to move upwardly along rod 56 until the curved end 62 is engaged. At this point, thrust rod link 66 pulls rod 56 upward which causes foot 46 to rotate upward about pins 48 on clamp 42 and disengage said flapper. In the alternate embodiment of FIG. 2, after the flapper 34 is closed over the opening to outlet pipe 28, the upward force to handle 18 is reduced. Spring 112, being deformed, then forces rod 106 upward which in turn pulls upward on foot 46 and causes it to rotate upward and away from flapper 34.

Figure 5:
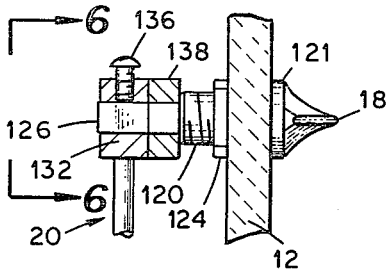
FIG. 5 shows an alternate method of attaching the trip lever to the handle shaft.
Figure 6:
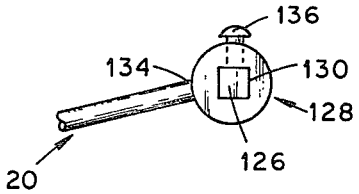
FIG. 6 illustrates a side view of the details of the alternate method of FIG. 5.

Referring to FIG. 5 and FIG. 6, a means for securing trip lever 20 to handle 18 is shown. As was described with respect to FIG. 1, a threaded conduit 120 having permanently attached collar 121, is passed through wall 12 of tank 10 (not shown) and provides a passage and support for attaching trip handle 18 to trip lever 20. A threaded nut 124 is passed along the threaded conduit 120 on the inside of the tank 10 and is tightened against the inside of wall 12 such as to securely hold collar 121 against the outside of wall 12. A shaft 126 with a rectangular cross section is passed through the inside of conduit 120 and has one end securely fastened to handle 18. A second end 125 of shaft 126 extends pass the second end of conduit 120. A cylindrical collar 128 is shown with an aperture 130 having a rectangular cross section similar but slightly larger than the cross section of shaft 126. Collar 128 has an outer wall surface 132 to which is permanently attached to a first end 134 of trip lever 20. The second end (not shown) of trip lever 20 is attached to the lift chain as was discussed heretofore. A threaded screw 136 is threaded through the outside wall of collar 128 to the rectangular aperture 130 of collar 128. A washer or shim 138 is placed around the second end of shaft 126 and collar 128 is fitted onto the second end of shaft 126. Screw 136 is then tightened against the second end of the shaft such that the collar 128 and second end of 126 are securely joined.

It will be obvious to those skilled in the art that various changes may be made in the invention without departing from the spirit and scope thereof and therefore the invention is not limited by that which is shown in the drawings and described in the specification but only as indicated in the appended claims.

What is claimed is:

1. An apparatus for selectively terminating the flow of water from a conventional flush toilet which utilizes a tank, a flap valve over an outlet pipe and a trip lever, the improvement comprising:

a support located inside and securely attached to said tank;

a foot for engaging the flap valve hingedly attached to said support whereby said foot may rotate downward and engage the flap valve;

a substantially vertical thrust rod having first and second ends, said thrust rod having a first stop at said first end and second stop below said first end, said thrust rod being attached to said foot at said second end whereby downward vertical movement of said thrust rod causes said foot to rotate downward;

a thrust rod link with a first end attached to the trip lever and a second end slidably attached to said thrust rod between said first and second stops whereby a downward rotation of the trip lever causes said second end of said link to slide vertically downward until it engages said second stop and whereby continued downward movement carries said thrust rod downward such that said foot engages said flap valve and closes said flap valve against said outlet pipe; and resilient means for urging said foot upward whereby said foot disengages from said flap valve when downward force on said thrust rod is removed.

2. An apparatus for selectively terminating the flow of water from a conventional flush toilet which utilizes a tank, a flap valve over an outlet pipe operated by a chain, and a trip lever operated by a handle outside said tank for raising said chain comprising:

a support located inside and securely attached to said tank;

a foot for engaging the flap valve hingedly attached to said support whereby said foot may rotate downward and engage the flap valve;

a substantially vertical thrust rod having first and second ends, said thrust rod having a first stop at said first and a second stop below said first end;

a means for attaching said thrust rod to said foot at said second end whereby downward vertical movement of said thrust rod causes said foot to rotate downward;

a thrust rod link having a first and second end, said first end attached to said trip lever, and said second end slidably attached to said thrust rod between said first and second stops whereby downward movement by said second end of said link will cause said second end to slide vertically downward until it engages said second stop and whereby continued downward movement carries said thrust rod and said means for attaching downward such that said foot engages and closes said flap valve against said outlet pipe; and resilient means for urging said foot upward whereby said foot disengages from said flap valve when downward force on said thrust rod is removed.

3. The apparatus of claim 2 wherein said trip lever includes first and second ends, and said handle includes a shaft, said first end of said trip lever being attached to said shaft of said handle, and said second end of said trip lever being attached to said first end of said link rod and the chain on the flap valve and further comprising:

a cylindrical collar fitted through a wall of said tank for supporting said shaft of said handle which shaft connects said handle on the outside of said tank and said trip lever on the inside of said tank; and a means for permanently securing said collar to said tank.

4. The apparatus of claim 2 wherein said attaching means further comprises a rod with a first end fixedly attached to said foot and a second end pivotally attached to said second end of said thrust rod.

5. The apparatus of claim 1 or 2 wherein said support means is an overflow standpipe.

6. The apparatus of claim 1 or 2 wherein said resilient means further comprises a clamp member secured to said support means, a foot retractor rod slidably attached to said clamp member and held substantially vertical, a first end of said retractor rod pivotally attached to said foot and a second end of said foot retractor rod having a stop, against which is biased a first end of a compression spring, a second end of said compression spring being biased against said foot retractor rod urging it upward and thereby causing said foot to rotate upward when downward force on said thrust rod is removed.

* * * * *